US006126308A

United States Patent [19]

Hepfer et al.

[11] Patent Number: 6,126,308

[45] Date of Patent: Oct. 3, 2000

[54] CHAIN WHEEL ASSEMBLY UNIT FOR THE WEIGHT MOVEMENT OF A CLOCK

[75] Inventors: Rolf Hepfer, Bad Dürrheim; Jürgen Rünzler, Spaichingen, both of Germany

[73] Assignee: Keininger Uhrenfabrik GmbH, Aldingen, Germany

[21] Appl. No.: 09/252,858

[22] Filed: Feb. 17, 1999

[30] Foreign Application Priority Data

Feb. 18, 1998 [DE] Germany ..... 298 02 806 U

[51] Int. Cl.[7] ..... G04B 15/00; G04B 1/00

[52] U.S. Cl. ..... 368/124; 368/139

[58] Field of Search ..... 368/75, 76, 124–125, 368/134–139, 168, 179

[56] References Cited

U.S. PATENT DOCUMENTS 3,778,997 12/1973 Jauch .
4,098,068 7/1978 Masutama .
4,600,315 7/1986 Nakamura ..... 368/135

FOREIGN PATENT DOCUMENTS 21 232 2/1883 Germany .
25 100 11/1883 Germany .
812 538 9/1951 Germany .
1 035 061 7/1958 Germany .

*Primary Examiner*—Vit Miska
*Attorney, Agent, or Firm*—McGlew and Tuttle, P.C.

[57] ABSTRACT

Chain wheel assembly unit for weight movement of a clock movement and/or of a striking train of a clock comprises a chain wheel (22), which is arranged on a shaft (1) between two coaxial profiled disks (20, 21), is in rotary connection with a drive gear (7) axially fixed on the shaft (1) via a directional locking mechanism in the direction of drive and is pressed with its two profiled disks (20, 21) against the drive gear (7) by a spring in the axial direction. The chain wheel (22) and the first profiled disk (20) located between it and the drive gear (7) are in connection with one another, rotating in unison, at least in the direction of drive, through a coupling element (14). This profiled disk (20) has at least one axially movable flexible tongue (31 through 34), which engages a support surface ring (9) of the drive gear. The second profiled disk (21) is designed as a mute disk and holds together the parts which are otherwise seated loosely on the shaft (1).

13 Claims, 2 Drawing Sheets

CHAIN WHEEL ASSEMBLY UNIT FOR THE WEIGHT MOVEMENT OF A CLOCK

FIELD OF THE INVENTION

The present invention pertains to a chain wheel assembly unit for the weight movement of the clock movement and/or a striking train of a clock with a chain wheel, which is arranged on a shaft between two coaxial profiled disks, which have each a support shoulder provided with a radially outwardly projecting movable flange, wherein the chain wheel is in rotary connection with a drive gear axially fixed on the shaft in the driving direction of rotation via a directional locking mechanism and is pressed, together with its two profiled disks, by a spring against the drive gear in the axial direction.

BACKGROUND OF THE INVENTION

In the prior-art chain wheel assembly units of this class, the directional locking mechanism comprises a ratchet wheel connected to the chain wheel to rotate in unison with it and a detent pawl, which elastically engages the teeth of the ratchet wheel and is mounted on a bearing journal of the drive gear.

The drive gear itself is fastened to the shaft in an axially fixed manner. In most embodiments of the prior-art chain wheel assembly units, the drive gear is either pressed directly onto the shaft or is fastened to a bearing bush, which is in turn pressed onto the shaft.

The two profiled disks enclosing the chain wheel between them have a ring-shaped contact shoulder each, on which the link chain engaging the chain wheel and guided over the chain wheel is supported. In addition, these profiled disks are provided with a movable flange each, which adjoins the support shoulder and is used to guide the vertically extending chain sections in the area of the chain wheel.

The circular ring-shaped sections located within the support shoulders have different designs in the two profiled disks. While the ratchet wheel of the directional locking mechanism, which is in contact with a ring wall located in the same plane as the movable flange, is arranged on the outside at the profiled disk facing the drive gear, the opposite profiled disk in the center is provided with an outwardly slightly conically embossed ring section.

The two profiled disks, the chain wheel located between them, and the ratchet wheel are fastened to a common bearing bush, which is seated loosely on a common shaft, and they are adapted to rotate in unison.

These four components form a subassembly unit with the bearing bush which holds them together, while a second subassembly unit is formed by the shaft and the pressed-on drive gear, on which the detent pawl of the directional locking mechanism and the contact spring acting on the detent pawl are mounted and fastened. The spring which holds these two assembly units together on the common shaft comprises a central, perforated ring disk with three or more radial flexible tongues, which are in contact with the movable flange of the profiled disk facing it while the central ring disk is supported at a lock washer seated in a groove of the shaft.

Thus, this prior-art chain wheel assembly unit comprises a total of 10 individual parts, five of which, namely, the two profiled disks, the chain wheel located between them, and the ratchet wheel of the directional locking mechanism, must be mounted and connected with a bearing bush to form a first subassembly unit, while the other four components, namely, the shaft, the drive gear, the detent pawl and the detent pawl spring, must be fitted together into a second subassembly unit before the entire chain wheel assembly unit can be completed by means of the spring and the lock washer. In addition, to achieve a better press fit of the drive gear, the shaft must be provided with a fluting in the section in which the gear is seated.

These prior-art chain wheel assembly units are very expensive to manufacture, partly because they comprise many individual components and partly because they require a considerable assembly work.

A chain wheel assembly unit has also been known (DE Patent No. 25 100), in which the chain wheel comprises two conical, cast disks which form a hollow space of a wedge-shaped cross section between them, in which the weight chain is guided in an entrained manner. The directional locking mechanism, via which the drive gear seated firmly on its shaft is in drive connection with the chain wheel, may consist of a ring of ratchets, which is arranged on the front surface of the chain wheel and is held engaged with the spokes of the drive gear by an axially acting compression spring.

According to another embodiment, the chain wheel has a ring of ratchets on its front side facing away from the drive gear. This ratchet ring is engaged by two fingers of a leaf spring in the manner of detent pawls, which are fastened on the shaft, rotating in unison with it, by means of a pin connection.

This design is also complicated especially in terms of assembly.

SUMMARY AND OBJECTS OF THE INVENTION

The basic object of the present invention is to provide a chain wheel assembly unit of the type described in the introduction, which comprises a minimum number of individual parts, which can be manufactured in a simple manner and can be assembled easily, especially automatically, and which can thus be manufactured at a lower cost with equal functional quality.

This object is accomplished according to the present invention by the chain wheel and the first profiled disk located between this and the drive gear being in connection with one another, rotating in unison, at least in the direction of drive by a coupling element and by this profiled disk, preferably consisting of spring steel plate, having at least one axially movable flexible tongue connected to it in one piece, the flexible tongue engaging a concentric support surface ring of the drive gear in the manner of a detent pawl, and by the second profiled disk, which preferably likewise consists of spring steel plate, being designed as a mute disk and being provided as such with a plurality of radial mute tongues, whose inner catch or detent edges are supported on the shaft with a radial force and press the profiled disk axially elastically against the chain wheel and the latter with the first profiled disk against the drive gear as a result.

The prior-art ratchet wheel is replaced in the solution according to the present invention with the support surface ring of the gear, and the detent pawl (pallet) usually engaging the ratchet wheel, which brings about the entrainment of the drive gear in the direction of drive, is replaced with at least one, axially movable flexible tongue, which engages the support surface ring, which is functionally equivalent to the detent pawl.

While it is not necessary in the prior-art chain wheel assembly units to provide a connection ensuring rotation in unison between the chain wheel and the profiled disk separating the chain wheel from the drive gear, this profiled disk, arranged between the chain wheel and the drive gear, also acts in the chain wheel assembly unit according to the present invention at the same time as a coupling connection element which brings about a forced entrainment of the drive gear in the direction of drive. There is no entrainment in the opposite direction of rotation of the chain wheel due to the directional locking mechanism, which is located between the profiled disk and the drive gear and which comprises the elastic tongue and the support surface ring.

The chain wheel assembly unit thus designed has at least three fewer components than the prior-art chain wheel assembly units and can be manufactured at a substantially lower cost than the prior-art chain wheel assembly units simply because of this.

Due to one embodiment, another advantage is achieved insofar as the drive gear no longer needs to be pressed onto the shaft, which makes possible a less expensive assembly.

At the same time, it is possible to eliminate another component, namely, the separate spring, which presses the chain wheel with the two profiled disks against the axially fixed drive gear. In addition, the axial lock washer, at which the spring disk is supported in the prior-art chain wheel assembly units, is eliminated in the case of the second profiled disk being designed as a mute disk.

In another embodiment not only has the advantage that the support surface ring is part of the drive gear made in one piece with it, but also the added advantage that the support surface ring can be manufactured by means of a punching die in one operation and thus at a very low cost.

A functionally good engaged position is achieved between the flexible tongue or tongues and the support surfaces with the embodiment according to claim 4.

Due to the embodiment according another variation, the force transmitted from the chain wheel via the profiled disk or its coupling members to the drive gear can be distributed over a plurality of coupling elements.

Another embodiment is especially advantageous because the elastic tongues are arranged in a place located directly next to the end face of the drive gear and thus they are located at the shortest possible axial distance from the drive gear itself, so that they are practically not subject to bending stress during the transmission of force. In addition, the flexible tongues can also be manufactured in a simple manner by means of a punching or embossing die in one piece in the profiled disk, which means not only a substantial reduction in the manufacturing costs compared with one or even more detent pawls, their mounting and their catch springs.

This embodiment is also considerably less expensive compared with the embodiment known from DE Patent No. 25 100, because no toothed ring needs to be fastened to the chain wheel body.

In addition, it is possible, to arrange the flexible tongues with their ratchet surfaces such that only a few of these ratchet surfaces are simultaneously engaged with the support surfaces of the drive gear, while other ratchet surfaces of other detent springs come into engagement with the support surfaces of the support surface ring offset by, e.g., half a pitch of the support surface ring. The pitch of the support surface ring can thus be reduced, e.g., halved, in terms of action. It is possible as a result to select the cross section of the perforations of the support surface ring to be such that they can be readily punched, e.g., according to the precision punching process.

Due to the design according to the present invention of the individual parts, of which the chain wheel assembly unit is composed, this chain wheel assembly unit can also be easily assembled automatically, because all parts except the second profiled disk provided with the mutes can be pushed loosely over the shaft. However, the second profiled disk, which is designed as a mute disk at the same time, can also be pushed into its intended position on the shaft by means of a simple device without exerting great force. No special assembly tools are needed for the manual assembly.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENT

Figure 1:
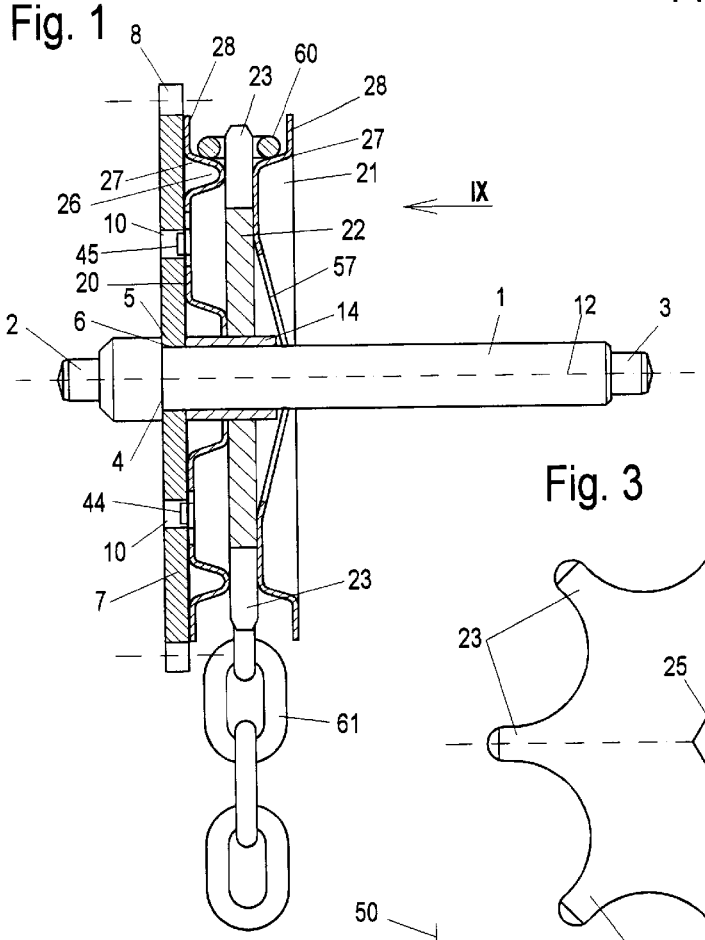
FIG. 1 is a sectional view of a chain wheel assembly unit.
Figure 2:
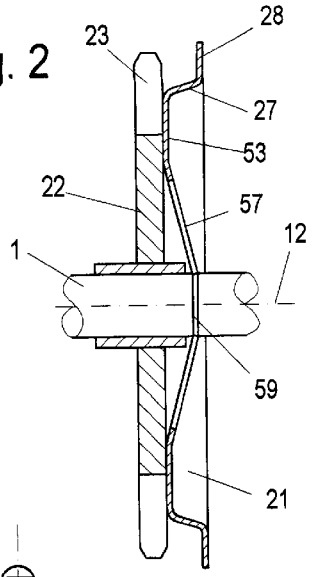
FIG. 2 is a view of parts of the chain wheel assembly unit from FIG. 1 with another shaft.
Figure 3:
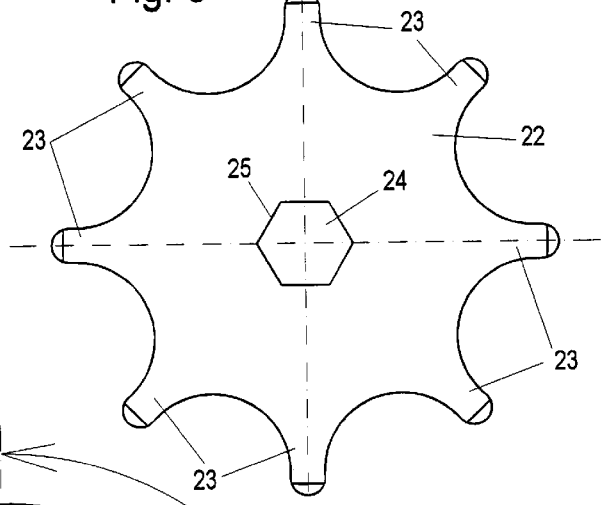
FIG. 3 is a side view of the chain wheel from FIG. 1.

Referring to the drawings, and in particular to FIG. 1, the chain wheel assembly unit comprises a shaft 1, the two bearing bushes 2 and 3 as well as a radial ring shoulder 4. A drive gear 7, which is arranged per se loosely on the shaft 1 and has radial serrations 8, is in contact on the front side with the ring shoulder 4 with the edge 5 of its central hole 6. This drive gear 7 is provided with a support surface ring 9, which consists of a plurality of essentially rectangular or trapezoidal or ring segment-like perforations 10. As can be best recognized from FIG. 4, these perforations 10 are arranged at equal angular distances a from one another in a circular ring 11 which is concentric to the hole 6 or the shaft axis 12. In the exemplary embodiment shown, the support surface ring 9 contains a total of 12 perforations 10, so that their angular distances $\alpha$ equal 30°, so that the pitch a of the support surface ring is also 30°.

Even though any desired number of perforations could be imaginable, in principle, it is useful to provide a number of perforations 10 divisible by "4"to make it possible, as will be explained in greater detail in the following description, for the flexible tongues engaging the support surface ring 9 to be always able to act in pairs.

On the side of the drive gear 7 opposite the ring shoulder 4, a coupling element 14 is rotatably arranged on the shaft 1. This coupling element 14 comprises a bush 15 with a hexagonal outer profile 16 and a cylindrical hole 17, whose diameter corresponds to the external diameter of the shaft 1, so that the bush 15 is freely rotatable on the shaft 1 with a small clearance.

A chain wheel 22, which has eight teeth 23 of the usual shape and a central perforation 24 with a hexagonal profile 25, is mounted on the coupling element 14 between two profiled disks, namely, a first profiled disk 20 and a second profiled disk 21. The hexagonal profile 25 is coordinated with the hexagonal outer profile 16 of the coupling element 14 such that the coupling element 14 is in positive-locking connection with the chain wheel 22, and is thus adapted to rotate in unison with it, via the hexagonal profile 25.

The axial length of the coupling member 14 is dimensioned to be such that it extends with a small axial clearance between the drive gear 7 and the radial mutes 57 of the second profiled disk 21.

Figure 5:
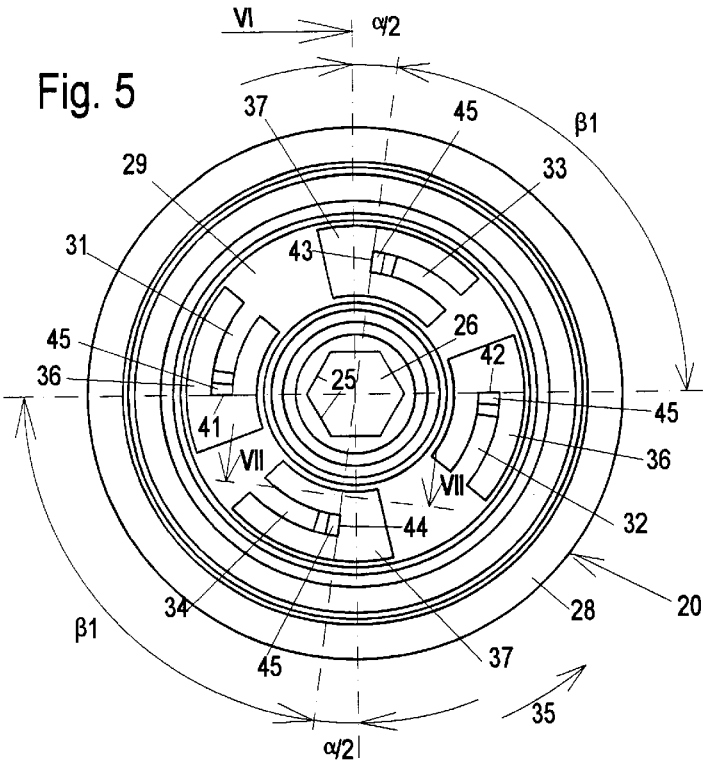
FIG. 5 is a side view of the profiled disk arranged between the chain wheel and the drive gear.
Figure 6:
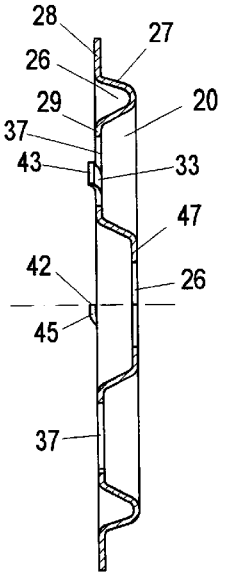
FIG. 6 is a sectional view VI—VI from FIG. 5.

The first profiled disk 20, which is shown as an individual part in FIGS. 5 and 6, also has a central perforation 26, which is likewise provided with the same hexagonal profile 25. Through this hexagonal profile 25, the profiled disk 20 is in positive-locking connection with the chain wheel 22, i.e., it rotates in unison with it, via the coupling element 14.

The coupling element 14 could also consist of a cylindrical bush, which would have only one entrained surface on its circumference. The perforations 24 and 26 of the chain wheel and of the profiled disk 20 would also have to be profiled correspondingly in this case.

The first profiled disk 20, which preferably also consists of spring steel plate, has a support shoulder 27, which is joined, projecting radially in the outward direction, by a ring flange 28.

Within the support shoulder 27, the first profiled disk 20 has a flat ring wall 29, which is located in the plane of the movable flange 28 and in which a total of four flexible tongues 31, 32 and 33 and 34, which are located diametrically opposite each other in pairs, are arranged in the form of free-cut ring wall sections. "Free-cut" means that the flexible tongues 31 through 33 are located in ring segment-like cutouts 36 and 37, respectively, of the ring wall 29 and are connected to the remaining parts of the ring wall 29 in one piece. As can be recognized from FIG. 1 and FIG. 6, the support shoulder 27 consists of the outer section of a V-shaped ring bead 26.

Figure 7:
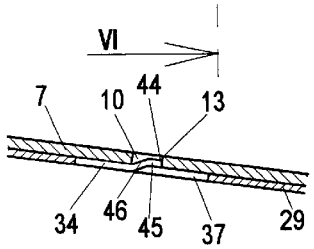
FIG. 7 is a partial sectional view VII—VII from FIG. 5, in which a ratchet spring engages the support surface ring of the drive gear.
Figure 8:
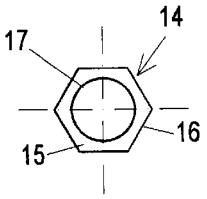
FIG. 8 is a front view of the coupling element connecting the coupling disk and the profiled disk located between the coupling disk and the drive gear to one another to rotate in unison.
Figure 9:
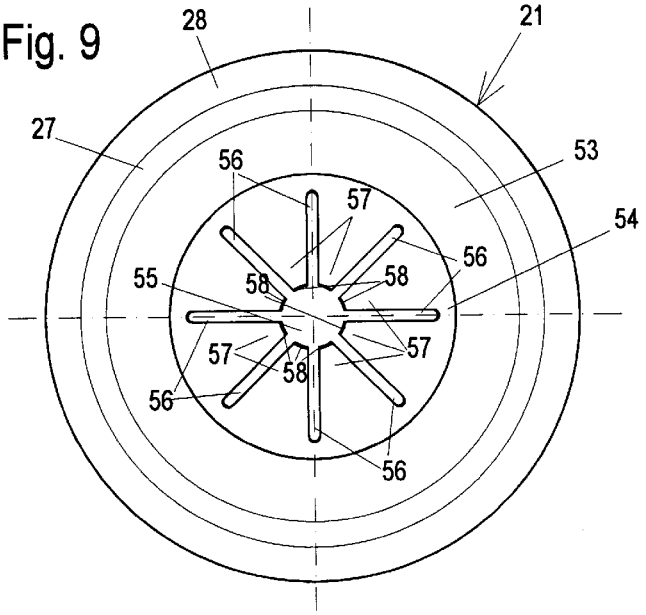
FIG. 9 is a side view IX from FIG. 1 of the second profiled disk.

These flexible tongues 31 through 34 are located on the same circular ring 11 as the support surface ring 9, and they are each provided with radial ratchet surfaces 41 and 42 as well as 43 and 44, which can engage one of the likewise radially extending support surfaces 13 of the perforations 10 of the support surface ring 9, as is shown, e.g., in FIG. 7. The end sections 45 of all flexible tongues 31 through 34, which are elastically movable in the axial direction, are offset by a corresponding embossing in relation to the drive gear 7 into its plane to the outside, which is done by means of a corresponding embossing die. As is apparent from FIG. 7, there is an oblique connection section 46 each between the end sections 45 offset into the plane of the drive gear 7 and the remaining partial sections of the flexible tongues 31 through 34. When the chain wheel 22 is rotated in the wind-up direction, i.e., against the direction of drive, in relation to the stationary drive gear, these oblique connection sections 46 cause these sections to be pushed axially out of the perforations 10 and into the plane of the ring wall 29 together with the sections 45.

These outwardly embossed end sections 45 are kept so short in the circumferential direction that they can completely dip into one of the perforations 10 of the support surface ring.

As can be best recognized from FIG. 6, the perforation 26 with the hexagonal profile 25 is located in a central, radially extending wall section 47, which is offset in relation to the annular wall 29 and the ring flange 28 by the width of the support shoulder 27, such that the support shoulder 27 and the outside of the central wall section 47 facing the chain wheel 22 are located in one plane and can be together in contact with the chain wheel 22.

As can be recognized from FIG. 1, the diameter of the ring flange 28 is smaller than the diameter of the root circle 30 of the radial serrations 8 of the drive gear 7.

Figure 4:
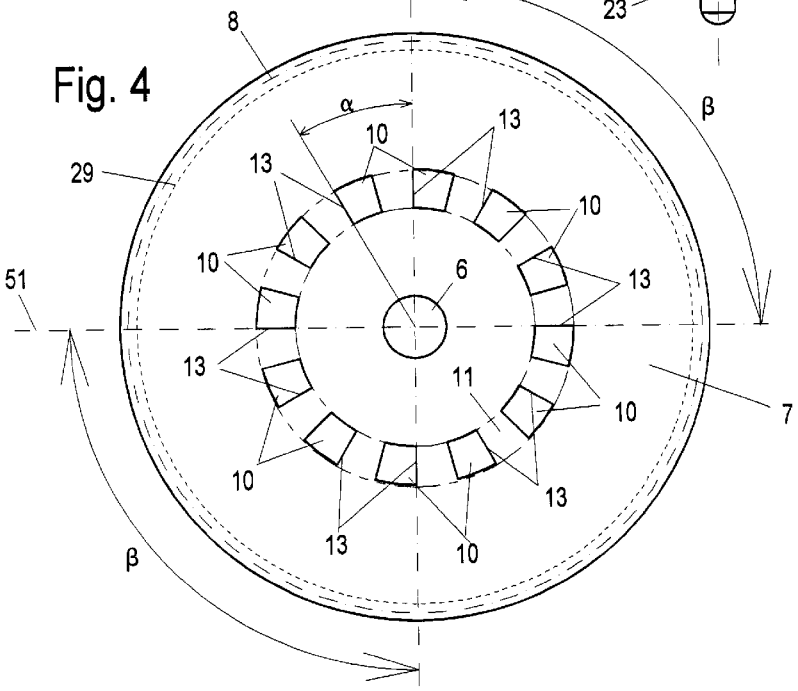
FIG. 4 is a side view of the drive gear from FIG. 1.

As can be recognized from FIG. 4, two each of the 12 support surfaces 13 of the support surface ring 9 present are located on a respective line 50 and 51 of the axes of coordinates, which means that the support surfaces 13 located on the line 50 have an angular distance $\beta$ of 90° from the support surfaces located on the line 51.

Only two of the four ratchet surfaces 41 through 44, which are likewise located diametrically opposite each other in pairs, shall always simultaneously engage two support surfaces 13 located diametrically opposite each other in pairs. The ratchet surfaces 41 and 42 therefore have an angular distance $\beta 1$ from the respective ratchet surfaces 43 and 44 located before and behind them in the direction of drive indicated by the arrow 35, which angular distance is smaller by half a pitch $\alpha/2$ of the support surface ring 9 or by half the angular distance $\alpha/2$ of the support surfaces 13 than the angular distance $\beta$ between the respective support surfaces 13 located next to these ratchet surfaces 41, 42 and 43, 44. It is achieved as a result that when the chain wheel 22 or the profiled disk 20 is rotated by half a pitch $\alpha/2$ in relation to the drive gear 7, the respective other ratchet surface pair 41/42 or 43/44 comes to engage the ratchet surfaces 13 of the support surface ring 9 which are the next ratchet surfaces in the corresponding direction of rotation. The same effect is thus achieved as with half as large a pitch of the support surface ring 9 or with half as large an angular distance $\alpha$ of 15° between two adjacent support surfaces 13.

Just as the support surface ring 9 may be provided with more or fewer than 12 perforations, it is also possible to provide the profiled disk 20 with more or fewer than 4 flexible tongues. However, it is advantageous to provide a number of support surfaces 13 divisible by "4" in the drive gear 7 and at least four flexible tongues with ratchet surfaces 41 through 44 located diametrically opposite in pairs to ensure that the ratchet surfaces 41 and 42 as well as 43 and 44 can always come to engage the support surface ring 9 or its support surfaces 13 in pairs. This results in a better distribution of the forces and thus in a higher functional reliability during the driving of the drive gear 7 by the chain wheel 22 via the flexible tongues 31 through 34 of the profiled disk 20.

The second profiled disk 21 arranged on the side of the chain wheel 22 that is opposite the drive gear 7 likewise has a support shoulder 27 and a movable flange 28, which are arranged symmetrically to the support shoulder 27 and the ring flange 28 of the profiled disk 20 in relation to the chain wheel 22.

A slightly conically outwardly directed ring wall 54, which has a central hole 55 and is divided into a plurality of wedge-shaped detent tongues 57 by a plurality of radial slots 56 arranged in a star-shaped pattern, eight radial slots in this example, is made in one piece with a radial ring wall section 53, which is located within the support shoulder 27. This second profiled disk 21 with its detent tongues 57 also consists of an elastic material, e.g., spring steel, so that the detent tongues 57 with their inner end edges 58 can be brought lockingly into engagement with the jacket surface of the shaft and the profiled disk 21 can be used at the same time as a mute disk for axially fixing the chain wheel 22, the profiled disk 20 and the drive gear 7 on the shaft 1.

It may be useful to provide the shaft 1 with a snap ring groove 59, with which the inner end edges 58 of the mutes 57 can be brought into positive-locking engagement.

As is apparent from FIG. 1, the support shoulders 27 of the two profiled disks 20 and 21 are used as contact surfaces for the chain links 60 of a drive chain 61, which are engaged by the teeth 23 of the chain wheel 22 in a positive-locking manner.

While two of the diametrically opposite flexible tongues 31 through 34 are in an entrained engagement due to their respective ratchet surfaces 41/42 and 43/44 with two, likewise diametrically opposite support surfaces 13 of the support surface ring 9 under a load on the chain wheel 22 in the direction of drive, the chain wheel 22 can be rotated with the first profiled disk 20 in relation to the drive gear 7 in the wind-up direction, i.e., opposite the direction of drive, and the flexible tongues 31 through 34 slide over the webs between the perforations 10 of the support surface ring 9 in a ratcheting manner during the rotary movement.

For a number of reasons, this chain wheel assembly unit can be manufactured at a considerably lower cost than the prior-art embodiments: It comprises a total of only six individual parts, which can be manufactured at a very low cost, and these individual parts only need to be pushed loosely over the common shaft 1, they are fixed on the shaft 1 by the second profiled disk 21 on the shaft 1, which is pushed on last, and fully automatic assembly is also possible.

While specific embodiments of the invention have been shown and described in detail to illustrate the application of the principles of the invention, it will be understood that the invention may be embodied otherwise without departing from such principles.

What is claimed is:

1. A chain wheel assembly unit for weight movement of a clock, the assembly comprising:

a shaft;

a chain wheel mounted on said shaft;

a drive gear mounted on said shaft, said drive gear including a concentric support surface ring;

first and second profiled disks mounted on said shaft, said chain wheel being arranged between said first and second profile disks, said first profile disk includes an axially movable flexible tongue engaging said concentric support ring in a manner of a detent pawl, said second profiled disk includes a plurality of radial mute tongues with inner edges supported on said shaft with a radial pressure and pressing said second profiled disk axially and elastically against said chain wheel, and also axially pressing said chain wheel and said first profiled disk against said drive gear;

a coupling element rotationally fixing together said first profile disk and said chain wheel.

2. The assembly in accordance with claim 1, wherein:

said profiled disks include a support shoulder and a radially outwardly projecting movable flange, said profiled disks are formed of spring steel plate, said second profiled disk is formed as a mute disk.

3. The assembly in accordance with claim 1, wherein:

said shaft includes a radial ring shoulder;

said drive gear is positioned adjacent said radial ring shoulder and is mounted rotatably on said shaft.

4. The assembly in accordance with claim 1, wherein:

said support surface ring defines a plurality of depressions arranged in a circular ring substantially concentric to an axis of said shaft, each of said plurality of depressions includes a support surface which have a substantially equal angular distance, pitch ($\alpha$), from each other.

5. The assembly in accordance with claim 4, wherein:

said support surfaces extend substantially radially to said axis of said shaft.

6. The assembly in accordance with claim 4, wherein:

said first profiled disk includes a plurality of said tongues, each of said tongues extend in a circumferential direction and are provided with a radial ratchet surface, said plurality of tongues are located along said circular ring of said support surface ring and are each engagable with one of said support surfaces.

7. The assembly in accordance with claim 6, wherein:

said profiled disks include a support shoulder and a radially outwardly projecting movable flange, said first profiled disk includes a flat ring wall radially within said support shoulder, said flat ring wall is located substantially in a plane of said movable flange;

said flexible tongues are free-cut ring wall sections.

8. The assembly in accordance with claim 4, wherein:

one of said ratchet surfaces has an angular distance ($\beta$1) from an adjacent said ratchet surface, said angular distance ($\beta$1) is one of greater or smaller by approximately half a said pitch ($\alpha$/2) of said support surfaces of said support surface ring than an angular distance ($\beta$) between said ratchet surfaces at a next said support surface.

9. The assembly in accordance with claim 4, wherein:

said support surface ring of said drive gear has an even number of said support surfaces and said even number is divisible by 4;

said first profiled disk is provided with four said ratchet surfaces which are located diametrically opposite each other in pairs.

10. The assembly in accordance with claim 1, wherein:

each of said first profile disk and said chain wheel define a profiled perforation;

said coupling sleeve has a circumference with an entrainment surface for rotational positive-locking engagement with said profiled perforation of said first profiled disk and said chain wheel.

11. The assembly in accordance with claim 1, wherein:

said coupling sleeve is rotatably movable on said shaft and extends substantially from said drive gear to said mute tongues of said second profiled disk.

12. The assembly in accordance with claim 10, wherein:

said profiled perforation of said first profiled disk is located in a central wall section of said first profiled disk, said central wall section is axially offset toward said chain wheel with respect to a ring wall of said first profiled disk adjacent said support surface ring.

13. The assembly in accordance with claim 1, wherein:

said shaft includes a snap ring groove for receiving said edges of said tongues in one of a ratcheting and locking manner.

* * * * *

UNITED STATES PATENT AND TRADEMARK OFFICE

CERTIFICATE OF CORRECTION

PATENT NO. : 6,126,308
DATED : October 3, 2000
INVENTOR(S) : HEPFER et al.

It is certified that error appears in the above-indentified patent and that said Letters Patent is hereby corrected as shown below:

On the title page, item
[73] Assignee: Kieninger Uhrenfabrik GmbH
Aldingen, Germany

Signed and Sealed this

Tenth Day of April, 2001

*Attest:*

Nicholas P. Godici

NICHOLAS P. GODICI

*Attesting Officer*

*Acting Director of the United States Patent and Trademark Office*